US006488887B1

(12) United States Patent
Arai et al.

(10) Patent No.: US 6,488,887 B1
(45) Date of Patent: Dec. 3, 2002

(54) METHOD OF FABRICATING METAL COMPOSITE COMPACT

(75) Inventors: Tsuyoshi Arai, Kariya (JP); Isao Makino, Chiryu (JP); Eiji Mimura, Okazaki (JP); Hisashi Kayano, Toyoake (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/697,058

(22) Filed: Oct. 27, 2000

(30) Foreign Application Priority Data

Oct. 28, 1999 (JP) ..... 11-307283
Nov. 12, 1999 (JP) ..... 11-322386

(51) Int. Cl.[7] ..... B22F 7/00
(52) U.S. Cl. ..... 419/6; 419/5
(58) Field of Search ..... 419/5, 6, 7

(56) References Cited

U.S. PATENT DOCUMENTS 5,393,484 A * 2/1995 Seyama et al. ..... 419/37

FOREIGN PATENT DOCUMENTS

JP 3-232906 10/1991
JP 4-346604 12/1992
JP 7-90312 4/1995

* cited by examiner

*Primary Examiner*—Ngoclan Mai
(74) *Attorney, Agent, or Firm*—Harness, Dickey & Pierce, PLC

(57) ABSTRACT

A first compact (11) is molded by injection according to the MIM method in which a molding material composed of a mixture of metal powder and a binder is injected into a die for molding, after which a second compact (12) is molded by injection in close contact with the joining surface (110) of the first compact (11) thereby to fabricate a metal composite compact (1). The second compact (12) is molded by injection by making it flow and fill a die (8) in such a manner as to obtain a flow component (R) in the direction parallel to the joining surface (110) of the first compact (11) on the same joining surface (110). In a method according to another embodiment, cavity surfaces (60, 61) formed on a reference die (50) and a first replacement die (51), respectively, are placed in opposed relation to each other thereby to form a first cavity (71), in which the first compact (11) is molded by injection. Then, while leaving the first compact (11) in the cavity surface (60) of the reference die (50), only the first replacement die (51) is replaced by a second replacement die (52) having a cavity surface (62) of a different shape thereby to form a second cavity (72), into which the second compact (12) is molded by injection.

15 Claims, 12 Drawing Sheets

METHOD OF FABRICATING METAL COMPOSITE COMPACT

BACKGROUND OF THE INVENTION

1. Field of the Invention

The present invention relates to a molding method for fabricating a metal composite compact according to a metal powder injection molding (MIM) process by integrating two compacts of the same type, or of different types, of material.

2. Description of the Related Art

In recent years, metal powder injection molding (MIM) has been used as a method for fabricating a metal compact. According to this method, metal powder is mixed with a binder, to give fluidity, and is subjected to injection molding. Almost all the binder is removed by heating or the like from the compact in a degreasing step, and the compact is heated to a higher temperature to sinter the metal powder in a sintering step thereby to produce the desired product.

Also, a sintered metal composite compact can be fabricated by integrating a plurality of sintered compacts of the same type or different types of material using the MIM method. In such a case, as shown in FIGS. 6A and 6B, a first compact 91 fabricated in advance is inserted in a die 8. A second compact 92 of a material identical to or different from the first compact 91 is integrated with the first compact 91 and molded thereby to produce a metal composite compact. The integrated compact is later degreased and sintered to produce the aforementioned sintered metal composite compact.

However, the metal composite compact described above poses the problem that the concentration of the binder contained in the molding material is liable to increase in the boundaries of a plurality of compacts and a sound joining boundary cannot be obtained after sintering. Specifically, at the boundary surface S in FIG. 6B, a high binder concentration portion 918 is formed in the surface of the joining surface of the first compact 91, as shown in FIG. 7. On the other hand, the surface of the joining surface of the second compact 92 is also formed with a high binder concentration portion 928. The boundary is obtained in which the two high binder concentration portions 918, 928 join each other.

Specifically, the molding material used for the MIM method is a mixture of metal powder and a binder, and is fluidized by heating it to a predetermined temperature to liquefy the binder. In the fluidized state of the molding material, the binder has a higher fluidity than the metal powder.

As a result, as shown in FIG. 8, at the time of injection molding, the high binder concentration portion 951 of the molding material 95 blows out from the central portion of the flow path to the forward end and flows back around the side surface. Thus, the surface of the molded compact is formed with a layer high in both fluidity and binder concentration, which layer also remains in the boundary surfaces of the two compacts. The high binder concentration portion which first solidifies is subjected to a shearing force F by the internal flow on the side surface in contact with the die 8 along the direction of the flow. Therefore, the thickness of the high binder concentration portion on the side surface is thinner than that on the forward end portion.

In the case where the molding material is degreased while the high binder concentration portion remains on the boundary surfaces of a plurality of the compacts, a depression may be formed due to the loss of the binder. In such a case, a normal joint may not be obtained in the subsequent sintering process.

Also, according to the MIM method, a compact of a comparatively complicated shape can be fabricated. In the case where different types of material are integrated or a compact formed of a material of the same type is geometrically too complicated, however, the injection molding may not be accomplished at one time. In such a case, the two compacts are injection molded individually and integrated in a given step of the fabrication process.

According to a method in which a sintered compact is produced by integrating a plurality of parts of the same material or different types of material using the conventional MIM, a plurality of sintered compacts formed separately from each other are joined through an appropriate process such as welding. A welding step added after sintering, however, leads to an unstable quality and a higher cost due to an increased number of steps.

Another conventional method is an insert molding method such as disclosed in Japanese Unexamined Patent Publication (Kokai) NO. 3-232906, in which a first compact prepared separately is placed in a die and a second compact is molded by injection.

In this method, the first compact is required to be fabricated separately in advance, and therefore the number of steps is increased.

Also, in the case where the first compact is placed in a die, the size of the recess into which the first compact is inserted is required to be larger than the size of the compact, resulting in a lower dimensional accuracy. This is by reason of the fact that in the case where the recess and the compact have the same size, the compact is cut off or broken when inserted into the recess, leading to a higher rejection ratio.

Japanese Unexamined Patent Publication (Kokai) No. 7-90312 discloses still another method in which the die is formed with partitions and the injection molding is carried out in cavities sequentially for integration while moving the partitions.

In this case, a compact having a three-dimensional complicated shape which the MIM method is primarily intended for is very difficult to mold, and the realization of such a molding greatly complicates the die structure and the cost becomes higher.

In the case where the compact to be formed is small, it may be that the space for partitions cannot be secured or a sprue, a runner or the like cannot be arranged in the die.

Also, it is very difficult to obtain a plurality of compacts at a time without resolving the problem of a very complicated die structure and a higher cost.

Further, the provision of a multiplicity of sliding portions for moving the partitions shortens the life of the die.

Furthermore, as the result of adding the partitions, a multiplicity of sectional die surfaces are transferred to the compact and a superior surface cannot be obtained. Another problem is that a high dimensional accuracy cannot be secured due to the effect of the clearance unavoidably existing in the sliding parts of the partitions.

Japanese Unexamined Patent Publication (Kokai) No. 4-346604, on the other hand, discloses a method in which an inserted core is removed after forming a first compact and a second compact is molded by injection into the cavity formed by the core. Also, the second compact is molded by injection after the portion of the first compact to be in contact with the second compact is maintained at 20 to 70° C.

For the temperature of the outer surface of the first compact to be maintained at 20 to 70° C., however, it is necessary to wait until the temperature drops after injection molding in an ordinary injection molding machine, resulting in a very low productivity.

Also, the molding process using a core consumes a considerable length of time for mounting and demounting the core. Since the core is cooled once removed, it is necessary to wait until the core temperature increases to a predetermined level before continuing the injection molding, also resulting in a low productivity.

SUMMARY OF THE INVENTION

The present invention has been developed in view of the aforementioned problems, and a first object thereof is to provide a method of fabricating a metal composite compact in which the forming of a high binder concentration portion can be suppressed at the boundary surfaces of a plurality of compacts made of materials of different types or a material of the same type.

A second object of the invention is to provide a method of fabricating a metal composite compact including an integration of a plurality of compacts of the materials of different types or a material of the same type with a superior dimensional accuracy at low cost.

According to a first aspect of the invention, there is provided a method of fabricating a metal composite compact in which a first compact is molded by injection using the MIM method for injection-molding a molding material composed of a mixture of metal powder and a binder in a die, after which a second compact is molded by injection in close contact with the joining surface of the first compact thereby to integrate the first and second compacts, wherein the second compact is molded by injection in such a manner that the second molding material of the second compact is rendered to flow while being filled in the die to obtain a flow component in the direction parallel to the joining surface of the first compact.

The most noteworthy fact in the present invention is that the direction of flow of the second molding material is positively controlled when the second compact is molded by injection as described above to thereby create a direction of flow parallel to the joining surface of the first compact. This flow component parallel to the joining surface is not limited to the one flowing linearly from the beginning but also includes the one curved on a surface parallel to the joining surface.

In this aspect of the invention, after molding the first compact by injection, the second compact is molded by injecting the second molding material into a die in which the first compact is arranged. In the process, the second molding material creates a flow component parallel to the joining surface of the first compact on the same surface. As a result, the formation of a high binder concentration portion can be suppressed at the boundary portion (joining portion) between the first compact and the second compact.

According to a second aspect of the invention, there is provided a method of fabricating a metal composite compact wherein, after molding a first compact by the MIM method, a second compact is molded in close contact with a portion of the first compact, after which the first and second compacts are integrated with each other, comprising the steps of:

forming a first cavity by arranging the cavity surfaces of a reference die and a first replacement die in opposed relation to each other and molding the first compact by injection in the first cavity; and replacing only the first replacement die with a second replacement die having a cavity surface of a different shape while leaving the first compact on the cavity surface of the reference die, thereby forming a second cavity by the first compact and the cavity surface of the second replacement die, and molding the second compact by injection in the second cavity thereby to produce the metal composite compact including the first compact and the second compact integrated with each other.

In the fabrication method according to this aspect of invention, the first cavity is formed first of all by the reference die and the first replacement die. Specifically, two dies making up a first mold member are each formed with a cavity surface, and these two cavity surfaces are placed in opposed relation to each other thereby to form a first cavity of a shape corresponding to the desired first compact. The metal powder for the first compact is injected into the first cavity. The metal powder, as explained with reference to the prior art, is in the form of a mixture with a binder heated to a predetermined temperature and having fluidity.

After molding the first compact in the first cavity, only the first replacement die is replaced by the second replacement die without releasing the first compact. The second replacement die has a cavity surface corresponding to the desired shape of the second compact, and forms a second cavity with the surface of the first compact in opposed relation thereto. The metal powder for the second compact is injected into this second cavity. This metal powder is also in the form of a mixture with a binder heated to a predetermined temperature and having fluidity.

As described above, according to this invention, after molding the first compact by injection, the second compact can be molded by injection on the first compact without removing it from the die. Specifically, immediately after molding the first compact by injection, the second compact can be molded by injection within a short time simply by exchanging the first and second replacement dies with each other. As a result, the second compact can be brought into contact with the first compact left on the cavity surface of the reference die without significantly reducing the temperature of the first compact.

A very satisfactory condition of the boundary portion between the first compact and the second compact can be obtained by suppressing the temperature drop of the first compact.

Specifically, the first compact and the second compact each contain a binder as well as the metal powder making up the main component. In the case where a mixture of the binder and the metal powder is used for injection molding, the fluidity characteristic thereof causes the concentration of the binder in the surface portion to increase. Also, the binder solidifies and loses the fluidity when the temperature drops. In the case where a second compact is molded by injection on the surface of the first compact after the first compact is cooled and solidified, therefore, a boundary layer high in binder concentration may be formed between the first compact and the second compact. If the mold is degreased and sintered with a boundary layer high in binder concentration, the distance between the metal powder of the two compacts is increased excessively, thereby often making it impossible to obtain a satisfactory sintered state.

By maintaining an appropriately high temperature of the first compact as described above, the surface of the first compact can be maintained in a state of some fluidity. Even after the first compact is solidified, on the other hand, the fluidity thereof can be easily restored by the heat transmitted from the second compact. In such a case, therefore, the distance between the metal powder of the first and second compacts can be reduced by maintaining the fluidity of the portion of the boundary therebetween high in binder concentration. Thus, the quality of the sintered compact finally obtained can be improved.

Also, according to this invention, as described above, the fact that the first compact is left on the cavity surface of the reference die can improve the dimensional accuracy of the resulting metal composite compact.

Further, the second compact can be molded by injection substantially without intermission simply by replacing the first replacement die and the second replacement die with each other as described above. Therefore, the metal composite compact can be fabricated with a very high efficiency for a reduced fabrication cost. As described above, according to this invention, a fabrication method is provided in which a metal composite compact including a plurality of compacts of different types of material or the same type of material integrated with each other can be fabricated with a high dimensional accuracy at low cost.

The present invention may be more fully understood from the description of preferred embodiments of the invention, as set forth below, together with the accompanying drawings.

DESCRIPTION OF THE PREFERRED EMBODIMENTS

First Embodiment

Figure 1:
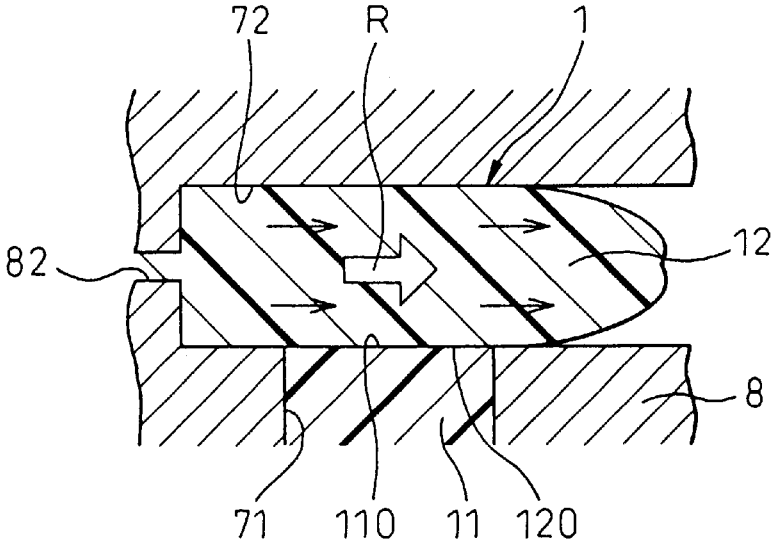
FIG. 1 is a diagram for explaining the fluid state of the second molding material according to a first embodiment of the invention.

A method of fabricating a metal composite compact according to an embodiment of the invention will be explained with reference to FIG. 1.

In this embodiment, a first compact 11 is molded by injection according to the MIM method for molding by injection of a molding material constituted of a mixture of a metal powder and a binder in a die, after which a second compact 12 is molded by injection in close contact with the joining surface 110 of the first compact 11, and the two compacts are integrated to fabricate a metal composite compact 1.

In the injection molding of the second compact 12, the second molding material of the second compact 12 is made to flow while being filled in the die 8 in such a manner as to obtain a flow component in the direction parallel to the joining surface 110 of the first compact 11 on the same joining surface 110.

A more detailed explanation will be given below.

In this embodiment, the first molding material of the first compact 11 is a mixture of stainless steel (JIS (Japanese Industrial Standard) SUS316) powder having an average grain size of 10 $\mu$m and a binder composed of PW, EVA, acryl and stearic acid. The second molding material of the second compact 12, on the other hand, is composed of a mixture of powder of SUS410 having an average grain size of 10 $\mu$m and a binder composed of PW (paraffin wax), EVA (ethylene-vinyleacetate), acryl and stearic acid.

As shown in FIG. 1, a first compact 11 molded in advance is inserted in a first cavity 71 formed in a die 8, and a second molding material is injected into a second cavity 72 with the joining surface 110 thereof exposed thereto to mold a second compact 12. According to this embodiment, the first compact 11 is molded in another die beforehand and inserted into the first cavity 71 of the die 8. As an alternative, the first compact 11 may be injected directly into the first cavity 71 of the die 8 if the die 8 is properly designed. Also, in the embodiment, a gate 82 of the second cavity 72 is formed in the direction parallel to the joining surface 110.

It should be noted that, as shown in FIG. 1, the injection molding of the second compact 12 is carried out in such a manner that the second molding material is made to flow as a whole in the direction parallel to the joining surface 110 on the same joining surface 110. By doing so, a flow component R parallel to the joining surface 110 is generated on the joining surface 110 of the first compact 11.

As a result, the metal composite compact 1 obtained can be prevented from forming a high binder concentration portion, unlike the prior art, on the joining surfaces 110, 120 of the first compact 11 and the second compact 12, respectively.

This is considered to be due to the fact that, as shown in FIG. 1, the flow of the second molding material in the direction parallel to the joining surface 110 of the first compact 11 can produce at least the three effects described below.

Firstly, in the case where the molding material composed of a mixture of metal powder and a binder is made to flow, the binder high in fluidity is concentrated at high percentage at the forward end portion along the direction of flow of the material and the side surface of the material is reduced in binder concentration as compared with the forward end portion. By filling the second molding material in such a manner as to flow in the direction parallel to the joining surface of the first compact as described above, the portion of the second compact arranged in contact with the first compact is positioned at the side surface of the parallel flow component of the second compact which is originally comparatively low in binder concentration.

Secondly, since the second molding material flows in parallel to the joining surface of the first compact, a shearing force is generated against the joining surface. As a result, a high binder concentration portion, even if formed on the joining surface of the first compact, is scraped off by the shearing force.

Thirdly, in view of the continuous flow of the second molding material on the joining surface of the first compact, heat is continuously applied to the joining surface from the second molding material. Thus, the binder of hardened binder layer in the joining surface restores the fluidity and is brought out from the joining surface together with the second molding material.

Consequently, the boundary portion between the first compact 11 and the second compact 12, i.e. the joining surfaces 110 and 120 are both lower in binder concentration than in the prior art.

The resulting metal composite compact 1 is degreased and sintered. Thus, a sintered metal composite compact satisfactory in appearance and superior in quality can be obtained with the first compact 11 and the second compact 12 joined very firmly.

Second Embodiment

Figure 2:
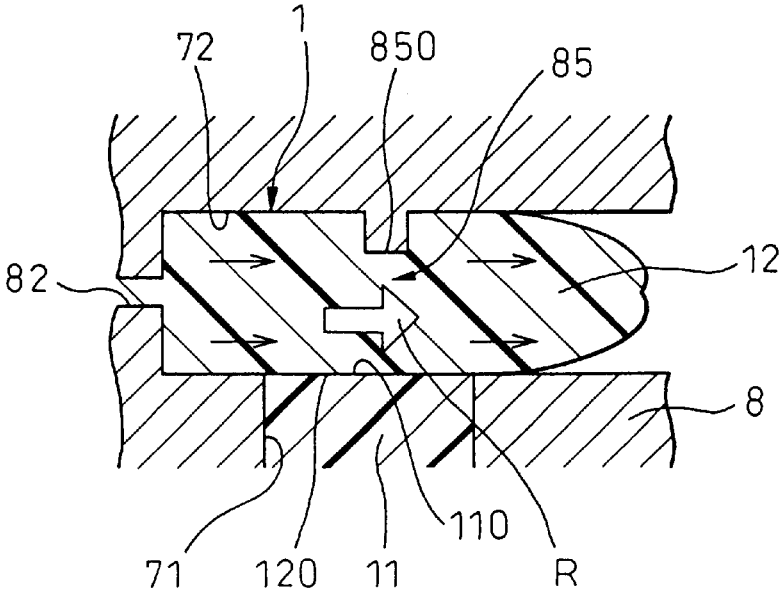
FIG. 2 is a diagram for explaining the fluid state of the second molding material according to a second embodiment of the invention.

According to this embodiment, as shown in FIG. 2, the die 8 in the first embodiment is reconstructed in such a way as to provide a narrow flow path portion 85 of the second molding material narrower than the portions before and after the particular portion on the joining surface 110 of the first compact 11. Specifically, a protrusion 850 is formed on the portion of the die 8 in opposed relation to the joining surface 110 of the first compact 11 thereby to form the narrow flow path portion 85.

In this case, the portion having a flow component R parallel to the joining surface 110 is increased in pressure by the presence of the narrow portion 85. Thus, the shearing force exerted from the second molding material to the joining surface of the first compact 11 can be increased. In this way, the effect of removing the binder component from the joining surface 110 can be enhanced.

The other points of the function and effect are similar to the corresponding points in the first embodiment.

Third Embodiment

Figure 3:
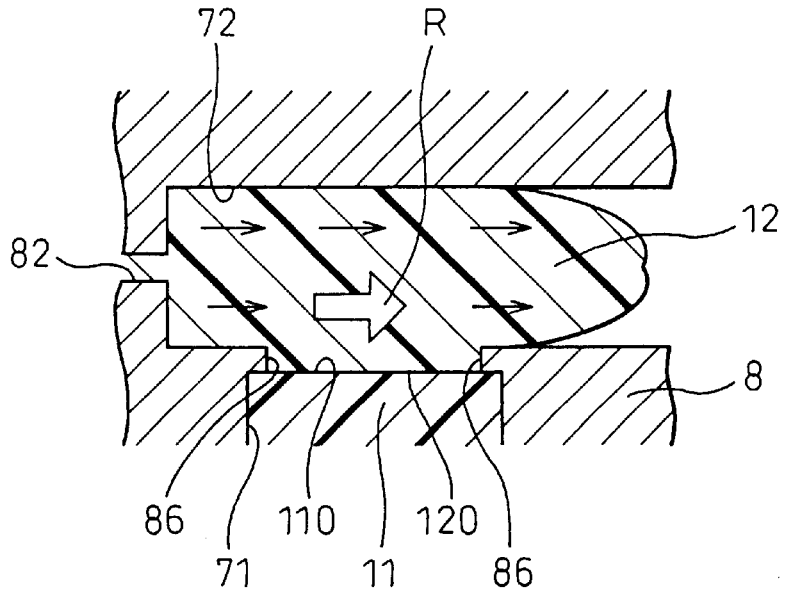
FIG. 3 is a diagram for explaining the fluid state of the second molding material according to a third embodiment of the invention.

According to this embodiment, as shown in FIG. 3, the shape of the second cavity 72 in the first embodiment is changed. Specifically, the position where the joining surface 110 of the first compact 11 is exposed to the second cavity 72 is slightly depressed and a step 86 is formed. Also in this case, a flow component R of the second molding material parallel to the joining surface 110 of the first compact 11 can be created on the same joining surface 110. In such a case, the flow path on the joining surface 110 is slightly widened and therefore, though the shearing force against the joining surface 110 is somewhat reduced, the function and effect substantially similar to those of the first embodiment can be obtained.

Fourth Embodiment

Figure 4:
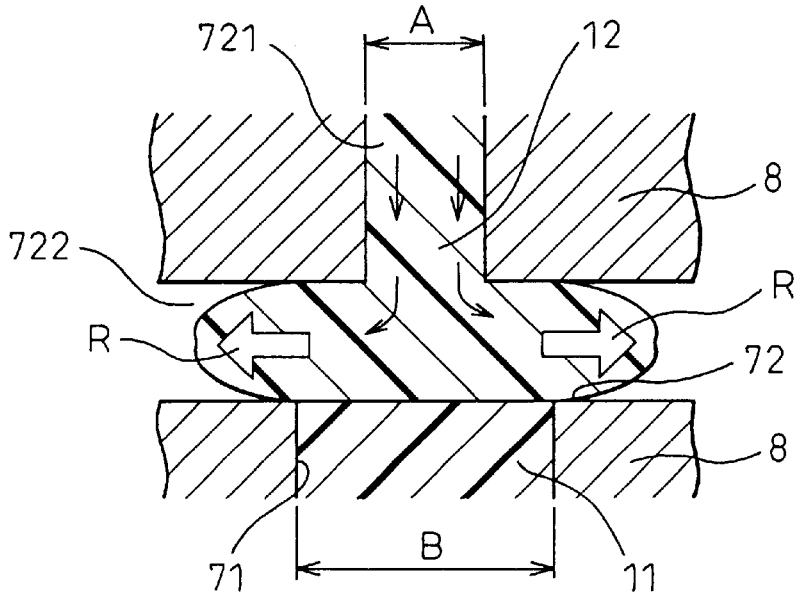
FIG. 4 is a diagram for explaining the fluid state of the second molding material according to a fourth embodiment of the invention.

In this embodiment, as shown in FIG. 4, the second molding material proceeds to flow from a direction not parallel to the joining surface 110 of the first compact 11 and comes to have a flow component R by changing the direction to one parallel to the joining surface 110 on the same joining surface 110.

Specifically, the second cavity 72 of the die 8 is substantially T-shaped, and the axis-side path 721 thereof is arranged in a form perpendicular to the joining surface 110 of the first compact 11, while the top-side path 722 is formed in parallel to the joining surface 110. Also, the width A of the axis-side flow path 722 that proceeds in from the direction not parallel to the joining surface 110 of the first compact 11 is narrower than the width B of the joining surface 110 of the first compact 11.

As a result, at the time of injection molding of the second compact 12, the second molding material is made to proceed in a direction perpendicular to the joining surface 110 of the second molding material and can change direction by 90 degrees at the joining surface 110. Thus, as shown in FIG. 4, a flow component R parallel to the joining surface 110 can be created on both left and right sides.

In this way, according to this embodiment, as in the first embodiment, the presence of the flow component R of the second molding material parallel to the joining surface 110 can suppress the formation of the high binder concentration area in the boundary portion between the first compact 11 and the second compact 12.

Fifth Embodiment

Figure 5:
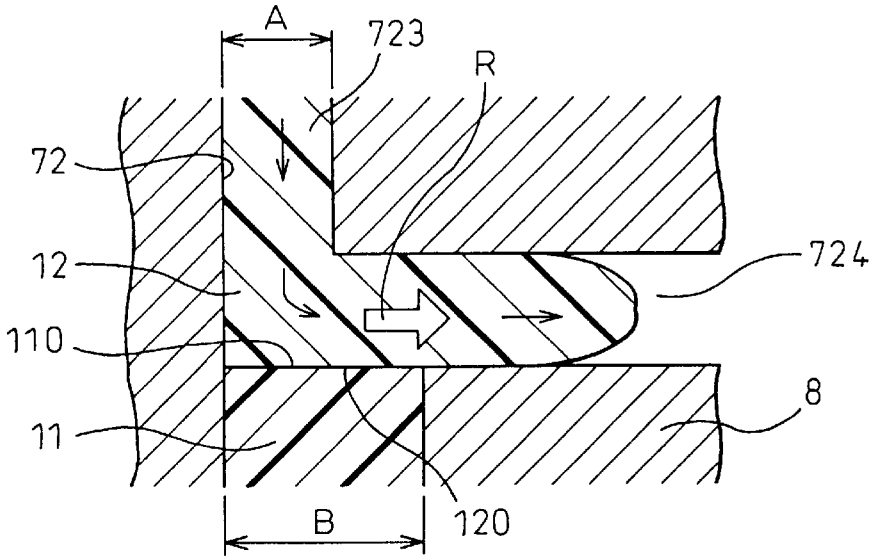
FIG. 5 is a diagram for explaining the fluid state of the second molding material according to a fifth embodiment of the invention.
Figure 6A:
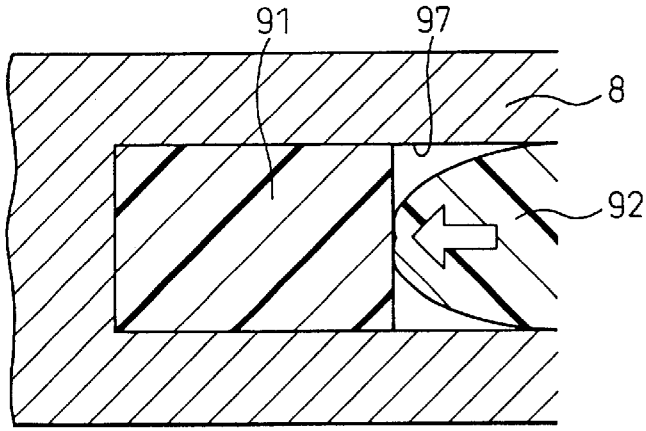
FIG. 6A is a diagram for explaining the fluid state of the second molding material according to the prior art.
Figure 6B:
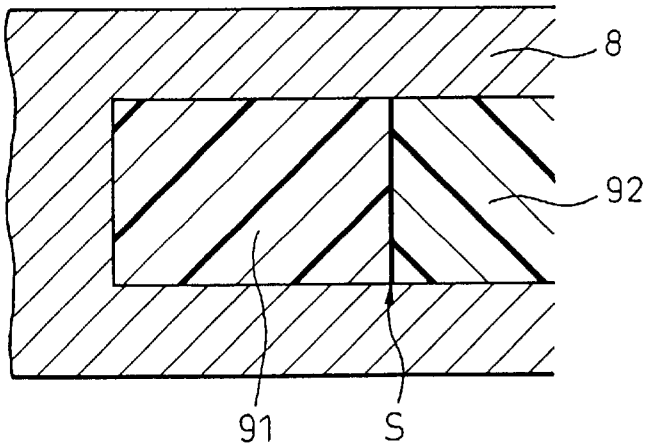
FIG. 6B is a diagram for explaining the state upon completion of filling the second molding material according to the prior art.
Figure 7:
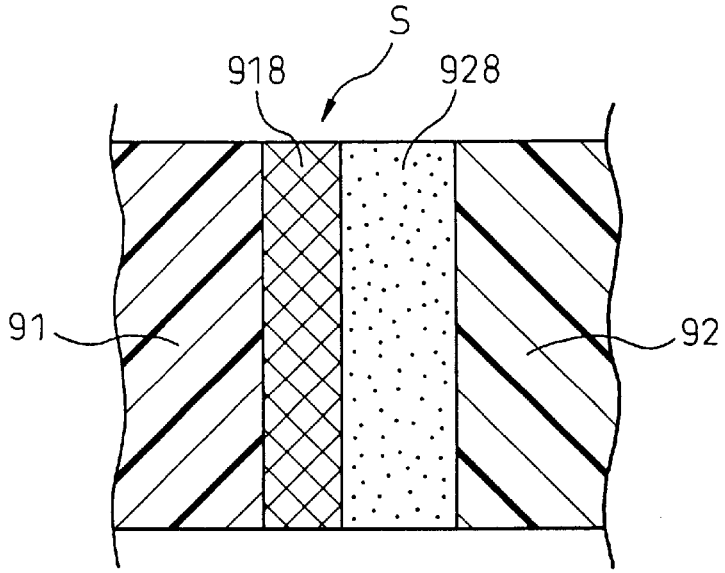
FIG. 7 is a diagram for explaining the configuration of a plurality of compact boundary surfaces according to the prior art.
Figure 8:
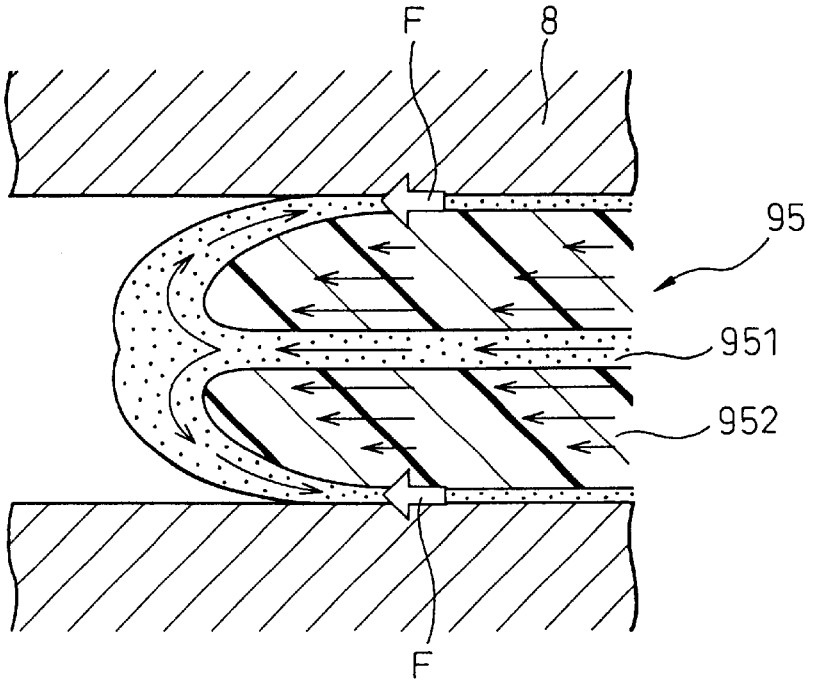
FIG. 8 is a diagram showing the manner in which the molding material flows according to the prior art.

According to this embodiment, as shown in FIG. 5, the second cavity 72 of the die 8 is L-shaped. Specifically, a vertical path 723 perpendicular to the joining surface 110 of the first compact 11 and a horizontal path 724 parallel to the joining surface 110 are combined to form a second cavity 72. Also in this embodiment, the width A of the vertical path 723 proceeding in a direction not parallel to the joining surface 110 of the first compact 11 is narrower than the width B of the joining surface 110 of the first compact 11.

According to this embodiment, at the time of injection molding of the second compact 12, the second molding material proceeds in a direction perpendicular to the joining surface 110 and can change, by 90 degrees, its direction at the joining surface 110. As a result, as shown in FIG. 4, a flow component A parallel to the joining surface 110 can be formed. Also in this case, the function and effect similar to those of the fourth embodiment can be secured.

Sixth Embodiment

A method of fabricating a metal composite compact according to a sixth embodiment will be explained with reference to FIGS. 9 to 12.

Figure 9:
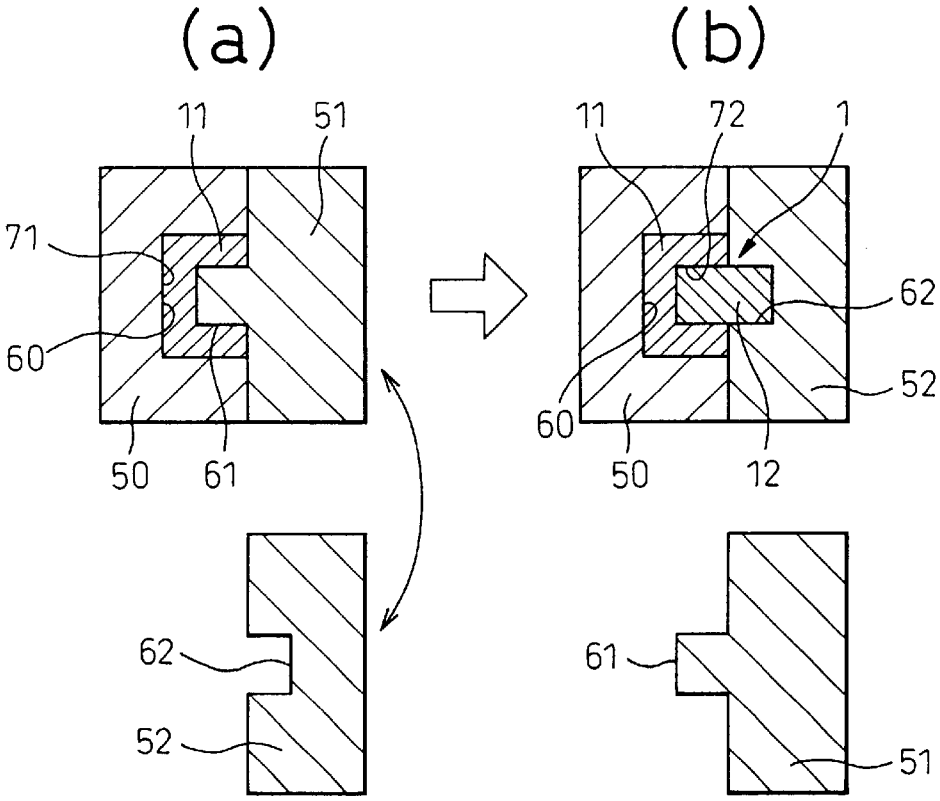
FIG. 9A is a diagram for explaining a method of fabricating a metal composite compact according to a sixth embodiment of the invention.
Figure 10:
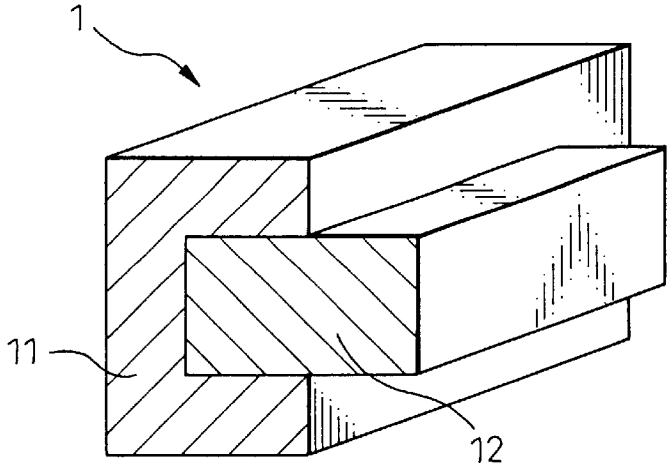
FIG. 10 is a partly cutaway perspective view showing the shape of a metal composite compact according to the sixth embodiment of the invention.

In the method according to this embodiment, as shown in (a) and (b) of FIG. 9, after the first compact 11 is molded by the MIM method, the second compact 12 is formed in close contact with a portion of the first compact 11, and both are integrated to fabricate the metal composite compact 1 (FIG. 10).

The die 5 used for metal powder injection molding in this embodiment, as shown in (a) and (b) of FIG. 9, includes a reference die 50, a first replacement die 51 and a second replacement die 52. The dies 50 to 52 are provided with the cavity surfaces 60 to 62, respectively. As shown in (a) of FIG. 9, the cavity surfaces 60 and 61 formed on the reference die 50 and the first replacement die 51, respectively, are arranged in opposed relation to each other to form a first cavity 71 corresponding to the desired shape of the first compact 11. Also, the cavity surface 62 of the second replacement die 52 is formed in a way corresponding to the desired shape of the second compact 12, and as described later, constitutes a second cavity 72 corresponding to the desired shape of the second compact in collaboration with the first compact 11.

Also, the first replacement die 51 and the second replacement die 52 can be replaced with each other.

In this embodiment, a metal composite compact is fabricated by the MIM method using the die 5.

First, stainless steel (JIS SUS630L) having an average grain size of 10 $\mu$m is prepared as metal powder for the first compact 11, and acryl, EVA, wax and stearic acid are prepared as a binder. The softening temperature of the binder for the first compact is 60° C.

Also, stainless steel (JIS SUS410L) having an average grain size of 10 $\mu$m is prepared as metal powder for the second compact 12, and the same material as that of the first compact is prepared for the binder.

Each metal powder and the binder are mixed and kneaded at a temperature not lower than the binder softening temperature thereby to produce the material for injection molding of the first compact and the second compact.

Then, as shown in (a) of FIG. 9, the cavity surfaces 60 and 61 of the reference die 50 and the first replacement die 51, respectively, are placed in opposed relation to each other thereby to form the first cavity 71. The injection material for the first compact is injected into the first cavity 71 for injection molding of the first compact 11. According to this embodiment, the injection temperature of the first compact is set to about 180° C.

As the next step, as shown in (b) of FIG. 9, while leaving the first compact 11 in the cavity surface 60 of the reference die 50, only the first replacement die 51 is replaced with the second replacement die 52 having a cavity surface 62 of a different shape, so that the second cavity 72 is formed of the cavity surface 62 of the second replacement die 52 and the first compact 11. The injection material for the second compact is injected into the second cavity 72 thereby to form the second compact 12 by injection molding. In the process, the injection temperature of the second compact is set to 180° C.

As a result, as shown in FIG. 10, a metal composite compact 1 is obtained by integrating the first compact 11 and the second compact 12 with each other.

By observing the boundary portion between the first compact 11 and the second compact 12 of the metal composite compact 1, it was found that the first compact 11 and the second compact 12 were joined in very satisfactory manner with substantially no portion having a high binder density.

This assembly was heated in $N_2$ to remove the greater part of the binder by decomposition, and then the assembly was sintered in a vacuum sintering furnace. Thus, a composite compact with the two compacts sintered integrally with each other was obtained.

This final composite material has the boundary portion of the first compact and the second compact sintered in a very satisfactory manner. This indicates that the boundary portion of the first compact and the second compact of the metal composite compact before sintering is constructed very securely.

The reason is considered below.

Specifically, in this embodiment, after injection molding of the first compact 11, the injection molding of the second compact 12 can be continuously carried out within a short time simply by replacing the first replacement die 51 with the second replacement die 52 without removing the first compact 11 from the cavity surface 60 of the reference die 50. Thus, the second compact 12 can be brought into contact with the first compact 11 without appreciably reducing the temperature of the first compact 11 remaining on the cavity surface 60 of the reference die 50. In other words, according to this embodiment, the second compact can be injected before the temperature of the first compact 11 decreases to less than 60° C. which is the softening temperature of the binder thereof. Therefore, the fluidity of the surface of the first compact 11 can be maintained to some degree at the time of contacting the second compact 12. As a result, a portion of high binder concentration can be fluidized in the boundary portion between the first compact 11 and the second compact 12. In this way, the distances between metal powder of the resulting metal composite compact can be reduced. A very satisfactory sintered compact can be obtained by degreasing and sintering this metal composite compact.

According to this embodiment, as described above, the second compact is injected while the temperature of the first compact is maintained at not lower than the softening temperature of the binder thereof. Even in the case where the temperature of the first compact is reduced below the softening temperature of the binder, however, the surface temperature of the first compact can be increased to not lower than the softening point of the binder by heat transmission by properly setting the injection temperature of the second compact.

(References)

In order to further clarify the effect of the method of fabricating the metal composite compact according to this embodiment, a metal composite compact was fabricated by the conventional method and the quality thereof was compared.

Figure 11A:
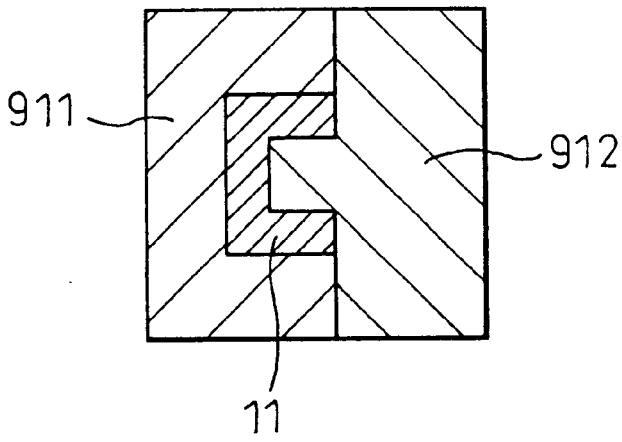
FIGS. 11A to 11C are diagrams for explaining a method of fabricating a metal composite compact according to a first reference for the sixth embodiment.
Figure 11B:
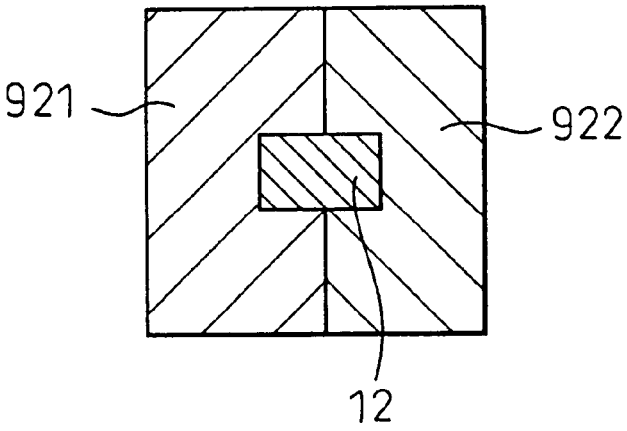
Figure 11C:
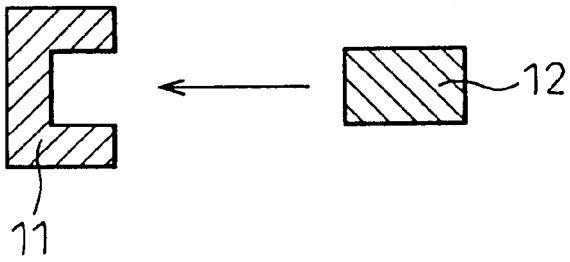

In a first reference (reference 1), as shown in FIGS. 11A and 11B, a pair of dies 911, 912 for molding the first compact and a pair of dies 921, 922 for molding the second compact were prepared. The first compact 11 and the second compact 12 were fabricated independently of each other and, as shown in (c) of FIG. 9, were integrated in subsequent process.

Figure 12A:
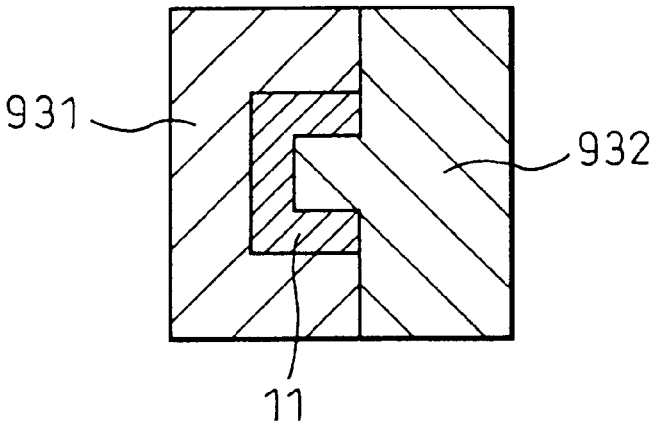
FIGS. 12A to 12C are diagrams for explaining a method of fabricating a metal composite compact according to a second reference for the sixth embodiment.
Figure 12B:
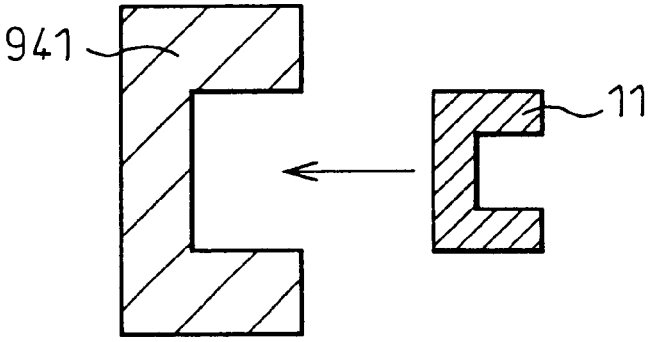
Figure 12C:
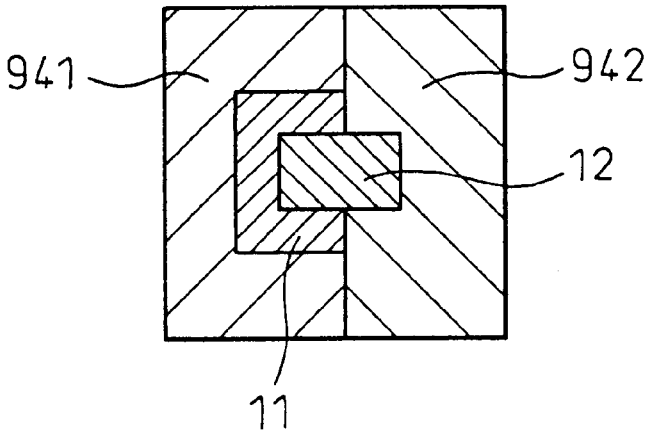

In a second reference (reference 2), as shown in FIGS. 12A and 12C, a pair of dies 931, 932 for molding the first compact and a pair of dies 941, 942 for molding an insert were prepared. As shown in FIG. 12A, the first compact was molded by the dies 931, 932, and then set in the cavity of the die 941 as shown in FIG. 12B. Then, the die 942 was placed in opposed relation and the second compact was molded by injection.

In reference 1, the two compacts 11, 12 were combined after being molded. The two compacts 11, 12 are not in close contact partly in the boundary portion thereof, and a high binder concentration portion was formed on each of the surfaces thereof. As the result of degreasing and sintering the compacts, a defective portion not fully joined was observed in the boundary portion.

In reference 2, the degree to which the two compacts 11, 12 are in close contact with each other in the boundary portion thereof was no problem, but a high binder concentration portion was formed. Also, the first compact 11 was deformed when inserted into the die 941. After degreasing and sintering, a defective portion not fully joined in the boundary portion and an unsatisfactory outer appearance were observed.

Seventh Embodiment

Figure 13:
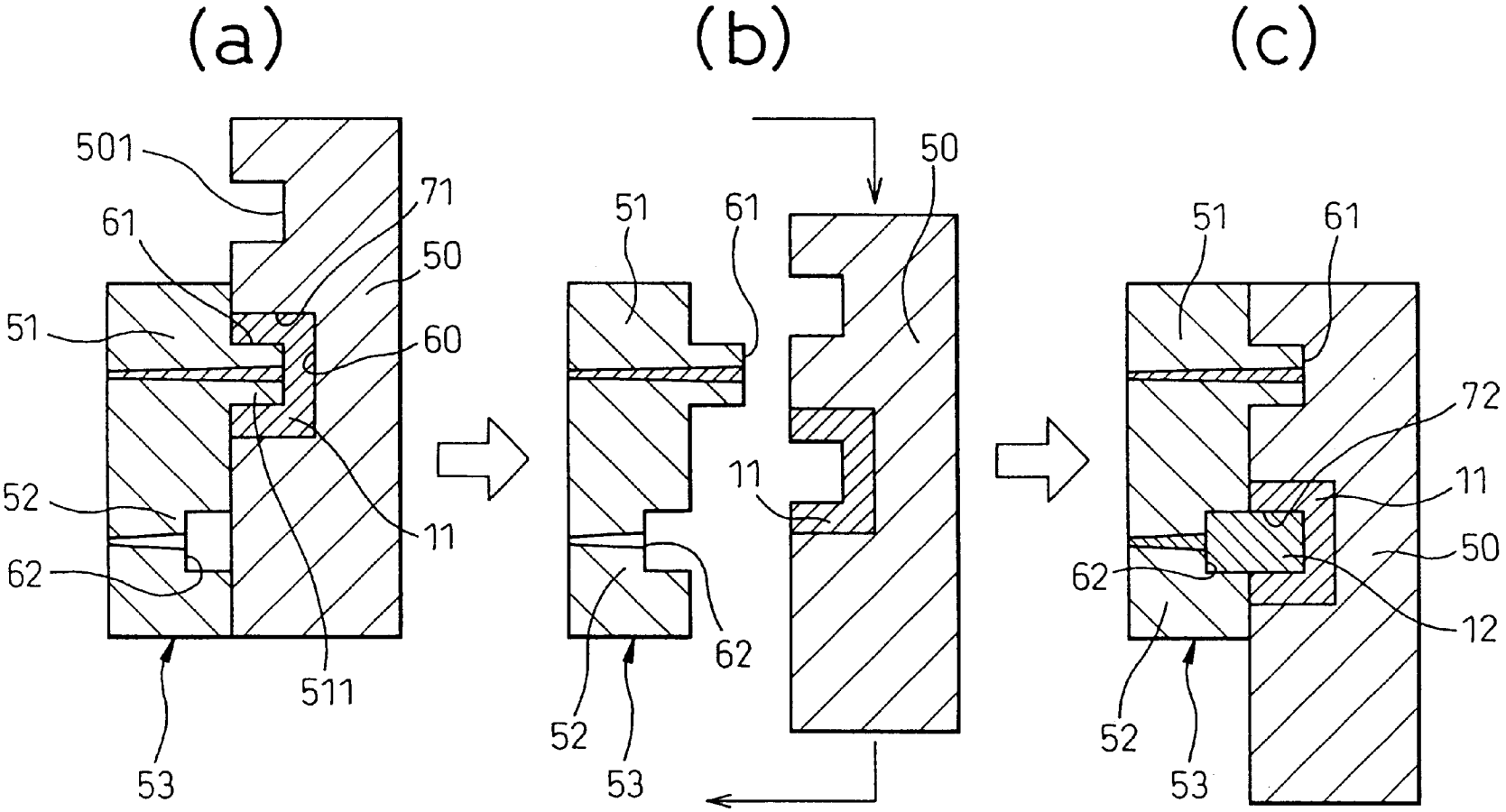
FIG. 13 is a diagram for explaining a method of fabricating a metal composite compact according to a seventh embodiment of the invention.

This embodiment is a specific example in which the first replacement die 51 and the second replacement die 52 in the sixth embodiment are replaced with each other by sliding, as shown in FIG. 13.

Specifically, the first replacement die 51 and the second replacement die 52 according to this embodiment, as shown in FIG. 13, are stacked and integrated as a replacement die 53. Also, the reference die 50 is increased in size and has a recess 501 into which the protrusion 511 of the first replacement die 51 is inserted to place the assembly in standby state.

According to this embodiment, the reference die 50 is slidable vertically while at the same time movable in two longitudinal directions.

In the actual process of molding the metal composite compact 1, as shown in (a) of FIG. 13, the first cavity 71 is formed by placing the cavity surface 61 of the first replacement die 51 in opposed relation to the cavity surface 60 of the reference die 50, and the first compact 11 is molded by injection into the first cavity 71.

Then, as shown in (b) of FIG. 13, the reference die 50 is slightly retreated, slid downward and advanced. As a result, as shown in (c) of FIG. 13, the second cavity 72 is formed by placing the cavity surface 62 of the second replacement die 52 in opposed relation to the first compact 11 remaining in the reference die 50. By molding the second compact 12 by injection into the second cavity 72, the metal composite compact 1 can be obtained.

In this case, the first replacement die 51 and the second replacement die 52 can be replaced by each other efficiently with a simple configuration. Also, the increased size of the replacement die 53 and the reference die 50 increases the thermal capacity of the dies, thereby making it possible to reduce the change in die temperature in continuous charging. As to the other points, a function and an effect similar to those of the sixth embodiment are obtained.

Eighth Embodiment

Figure 14:
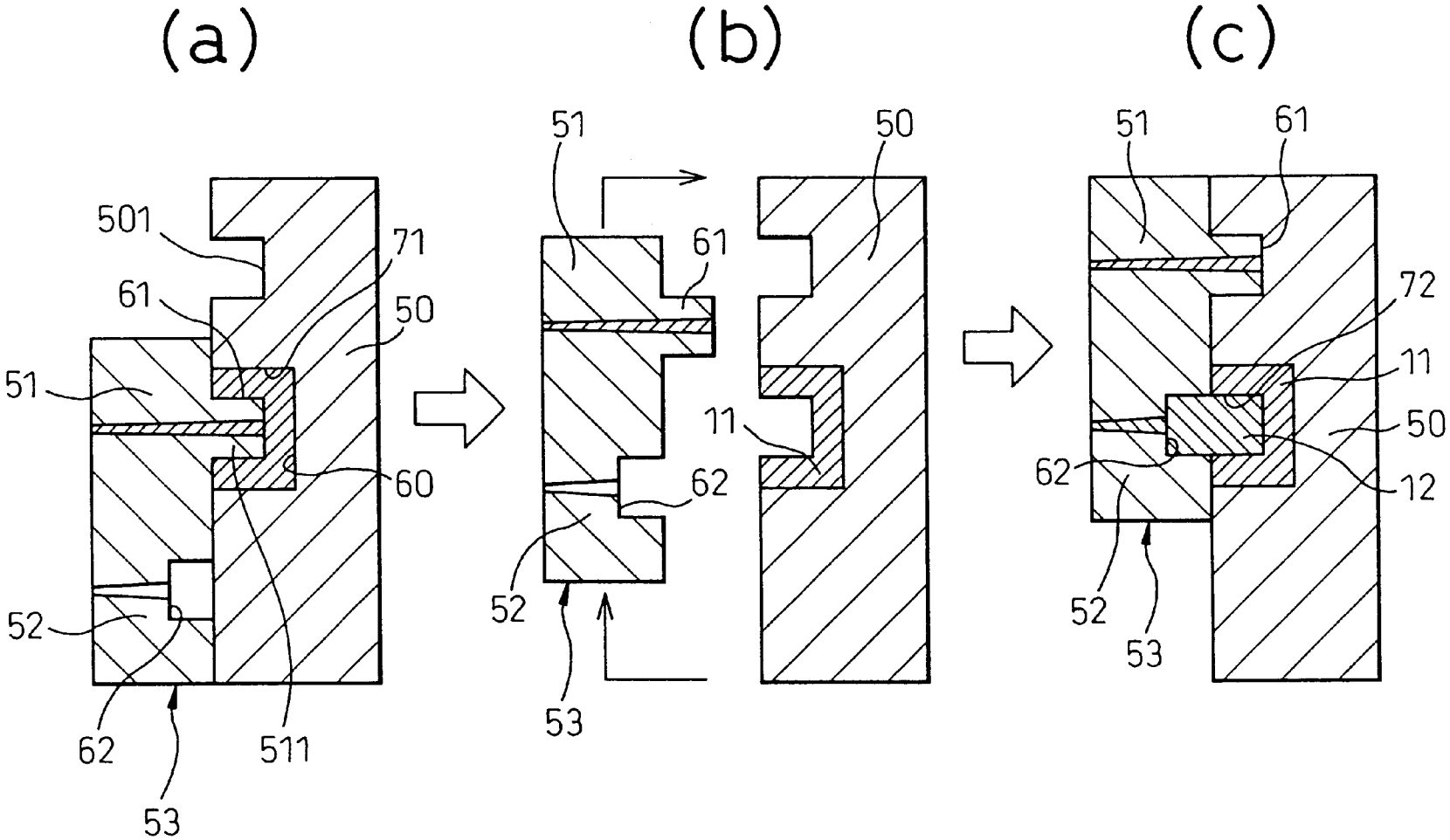
FIG. 14 is a diagram for explaining a method of fabricating a metal composite compact according to an eighth embodiment of the invention.

In this embodiment, as shown in FIG. 14, the replacement die 53 according to the seventh embodiment is movable and the reference die 50 is fixed.

Specifically, as shown in FIG. 14, the first replacement die 51 and the second replacement die 52 are integrated into a replacement die 53, which is both longitudinally movable and vertically slidable. On the other hand, the reference die 50, which is as large as in the seventh embodiment, is fixed.

In the actual process of molding the metal composite compact 1, as shown in (a) of FIG. 14, the first cavity 71 is formed by placing the cavity surface 61 of the first replacement die 51 in opposed relation to the cavity surface 60 of the reference die 50, and the first compact 11 is molded by injection into the first cavity 71.

Then, as shown in (b) of FIG. 14, the replacement die 53 is withdrawn somewhat, slid upward, and advanced. As a result, as shown in (c) of FIG. 14, the second cavity 72 is formed by placing the cavity surface 62 of the second replacement die 52 in opposed relation to the first compact 11 remaining in the reference die 50. By molding the second compact 12 by injection into the second cavity 72, the metal composite compact 1 is obtained.

In this case, too, a function and an effect similar to those of the seventh embodiment are obtained.

Ninth Embodiment

Figure 15:
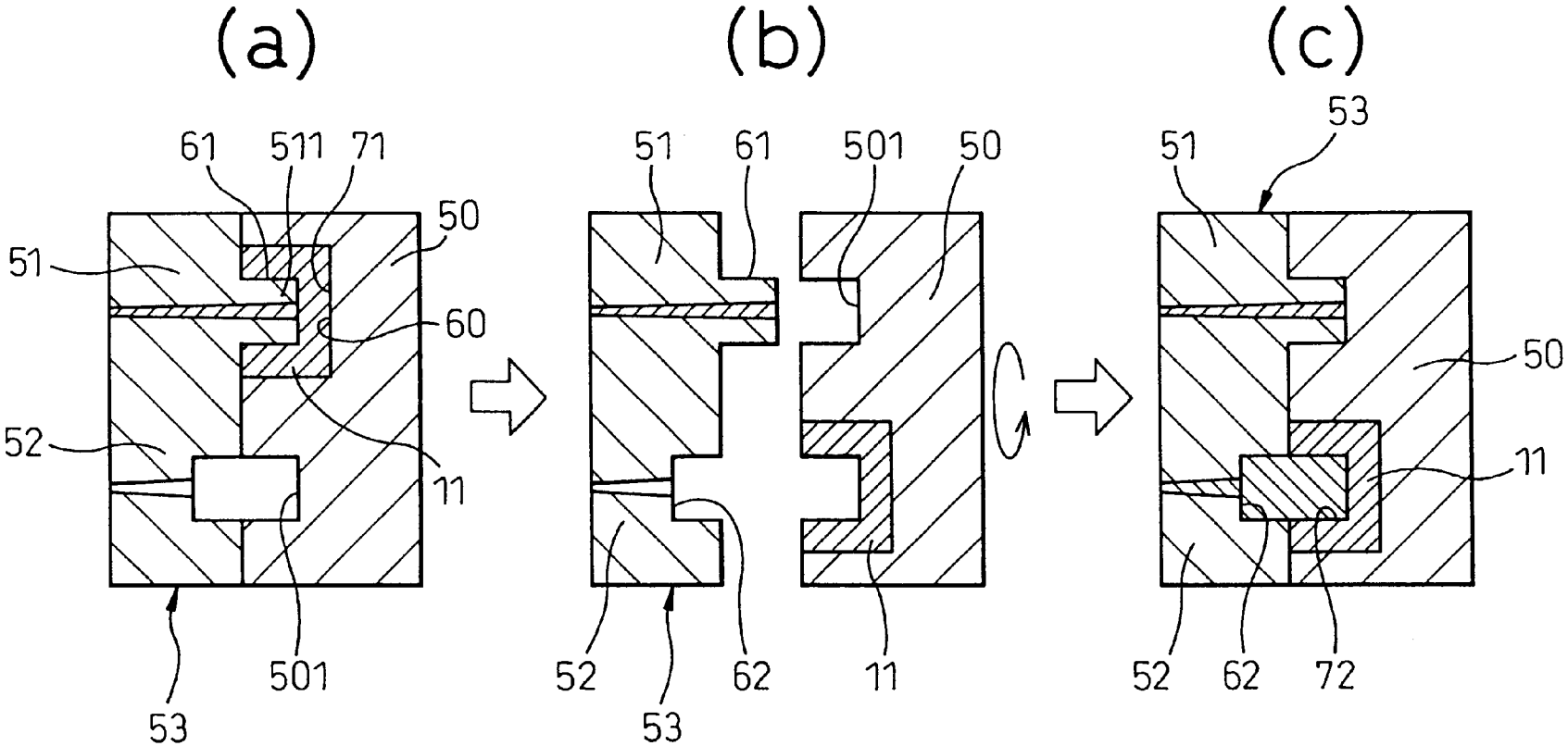
FIG. 15 is a diagram for explaining a method of fabricating a metal composite compact according to a ninth embodiment of the invention.

This embodiment is a specific example in which as shown in FIG. 15, the first replacement die 51 and the second replacement die 52 in the sixth embodiment are replaced by rotation.

Specifically, according to this embodiment, the first replacement die 51 and the second replacement die 52 are stacked and integrated into a replacement die 53 as shown in FIG. 15. The reference die 50 is large in size and has a recess 501 into which-the protrusion 511 of the first replacement die 51 is adapted to be inserted to place the assembly in standby state.

Also, according to this embodiment, the reference die 50 is both movable longitudinally and rotatable.

In the actual process of molding the metal composite compact 1, as shown in (a) of FIG. 15, the first cavity 71 is formed by placing the cavity surface 61 of the first replacement die 51 in opposed relation to the cavity surface 60 of the reference die 50, and the first compact 11 is molded by injection into the first cavity 71.

Then, as shown in (b) of FIG. 15, the reference die 50 is slightly withdrawn, rotated by 180° and advanced. As a result, as shown in (c) of FIG. 15, the second cavity 72 is formed by placing the cavity surface 62 of the second replacement die 52 in opposed relation to the first compact 11 remaining in the reference die 50. By molding the second compact 12 by injection into the second cavity 72, the metal composite compact 1 is obtained.

In this case, too, the first replacement die 51 and the second replacement die 52 can be replaced by each other efficiently with a simple configuration. Also, the increased size of the replacement die 53 and the reference die 50 increases the thermal capacity of the dies, so that a variation in the die temperature can be reduced during the continuous charging. As for the other points, a function and an effect similar to those of the sixth embodiment are obtained.

Tenth Embodiment

Figure 16:
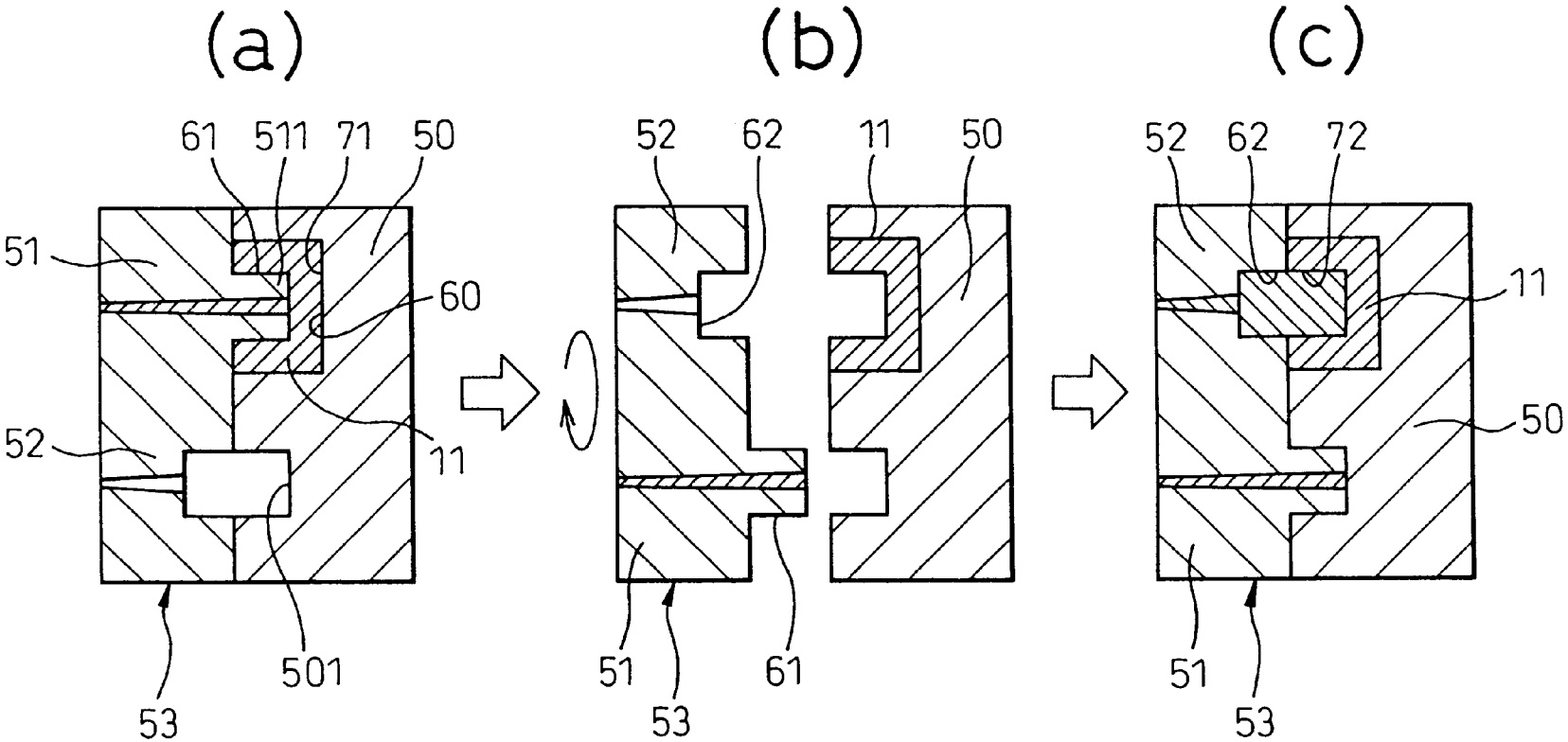
FIG. 16 is a diagram for explaining a method of fabricating a metal composite compact according to a tenth embodiment of the invention.

According to this embodiment, as shown in FIG. 16, the replacement die 53 in the seventh embodiment is rotatable and the reference die 50 is fixed.

Specifically, as shown in FIG. 16, the first replacement die 51 and the second replacement die 52 are integrated into a replacement die 53, which is movable longitudinally and is rotatable. Further, the reference die 50, which is also as large as in the eighth embodiment, is fixed.

In the actual process of molding the metal composite compact 1, as shown in (a) of FIG. 16, the first cavity 71 is formed by placing the cavity surface 61 of the first replacement die 51 in opposed relation to the cavity surface 60 of the reference die 50, and the first compact 11 is molded by injection into the first cavity 71.

Then, as shown in (b) of FIG. 16, the replacement die 53 is slightly withdrawn, slid upward and advanced. As a result, as shown in (c) of FIG. 16, the second cavity 72 is formed by placing the cavity surface 62 of the second replacement die 52 in opposed relation to the first compact 11 remaining in the reference die 50, and a metal composite compact 1 is obtained by molding the second compact 12 by injection into the second cavity 72.

In this case, too, a function and an effect similar to those of the ninth embodiment are obtained.

11th Embodiment

Figure 17:
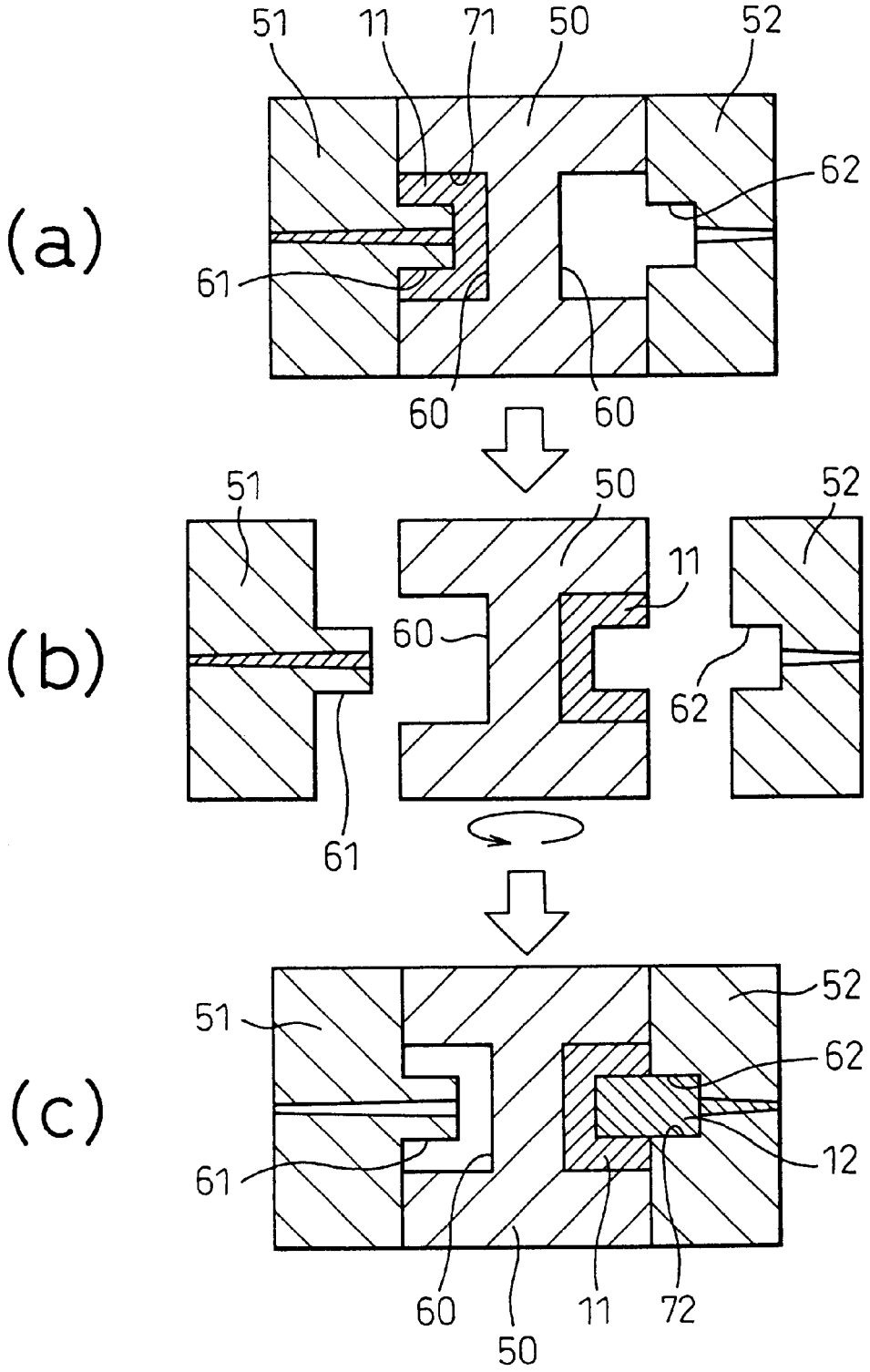
FIG. 17 is a diagram for explaining a method of fabricating a metal composite compact according to an 11th embodiment of the invention.

In this embodiment, as shown in FIG. 17, the first replacement die 51 and the second replacement die 52 are prepared as independent dies and placed in opposed relation to each other with the reference die 50 interposed therebetween rotatably.

The reference die 50 has cavity surfaces 60 opposed at 180° to each other, and is rotatable by 180°. Also, the first replacement die 51 and the second replacement die 52 are movable longitudinally.

In the actual process of molding the metal composite compact 1, as shown in (a) of FIG. 17, the first cavity 71 is formed by placing the cavity surface 61 of the first replacement die 51 in opposed relation to one cavity surface 60 of the reference die 50, and placing the cavity surface 62 of the second replacement die 52 in opposed relation to the other cavity surface 60. Then, the first compact 11 is molded by injection into the first cavity 71.

Then, as shown in (b) of FIG. 17, the first replacement die 51 and the second replacement die 52 are slightly withdrawn, after which the reference die 50 is rotated by 180° followed by advancing the first replacement die 51 and the second replacement die 52. As a result, as shown in (c) of FIG. 17, the second cavity 72 is formed by placing the cavity surface 62 of the second replacement die 52 in opposed relation to the first compact 11 remaining in the reference die 50. Then, the metal composite compact 1 is obtained by molding the second compact 12 by injection into the second cavity 72.

In the process, the first cavity 71 is formed again between the cavity surface 61 of the first replacement die 51 and the cavity surface 60 of the reference die 50 in opposed relation to the cavity surface 61. As a result, the injection molding of the first compact 11 carried out in this state makes it possible to mold the first compact 11 at the same time as the metal composite compact 1.

The advance and withdrawal of the first and second replacement dies 51, 52 and the rotation of the reference die 50 are repeated in the same manner as described above, while at the same time releasing the metal composite compact 1 during the rotation of the reference die 50. In this way, the injection molding can be performed continuously and very efficiently.

As described above, this embodiment realizes a very efficient production for a reduced fabrication cost.

As for the remaining points, a function and an effect similar to those of the sixth embodiment are obtained.

In the sixth to 11th embodiments, the injection molding of the second compact is desirably conducted while the first compact facing the second cavity is within a temperature range not lower than the softening point of the binder contained in the first compact and not higher than the decomposition temperature of the binder making up the first compact. In such a case, when the first compact and the second compact come into contact with each other, the fluidity of the binder in the boundary portion between them can be secured, thereby making it possible to positively suppress the formation of a high binder concentration portion in the boundary portion.

Also, the injection molding of the second compact is desirably carried out while the first compact facing the second cavity is within the temperature range not lower than 70° C. and not higher than the injection temperature of the metal powder of the second compact. In this case, the fluidity of the binder in normal use can be maintained substantially without fail. Further, the formation of the high binder concentration portion in the boundary portion can be positively suppressed.

Further, the injection temperature of the second compact is desirably 95 to 230° C. In the case where the injection temperature of the second compact is lower than 95° C., it may be difficult to positively remelt the binder making up the first compact. In the case where the injection temperature of the second compact is higher than 230° C., on the other hand, the binder making up the molding material of the second compact may be undesirably decomposed.

Also, at least one of the binders contained in the first compact and the second compact has desirably a component of miscibility (mutual solubility). In such a case, the diffusion between the binders in the boundary portion of the first compact and the second compact can be further facilitated, thereby leading to a further improved soundness of the boundary portion.

While the invention has been described by reference to specific embodiments chosen for purposes of illustration, it should be apparent that numerous modifications could be made thereto, by those skilled in the art, without departing from the basic concept and scope of the invention.

What is claimed is:

1. A method of fabricating a metal composite compact, said method comprising:

molding a first compact by injection molding a first molding material into a first cavity defined by a first die, said first compact defining a joining surface;

molding a second compact by injection molding a second molding material into a second cavity defined by a second die, said joining surface of said first compact defining a portion of said second cavity;

creating a first flow component of said second molding material in said second die in a direction generally parallel to said joining surface during said molding of said second compact; and integrating said first and second compacts during said molding of said second compact.

2. The method according to claim 1, fur ther comprising creating a second flow component of said second molding material in a direction which is n to generally parallel to said joining surface during said molding of said second compact prior to creating said first flow component.

3. The method according to claim 2, wherein a width of a flow path of said second flow component is less than a width of said joining surface in said direction generally parallel to said joining surface.

4. The method according to claim 1 further comprising forming said first molding material from a mixture of a first metal powder and a first binder.

5. The method according to claim 4 further comprising forming said second molding material from a mixture of a second metal powder and a second binder.

6. The method according to claim 1 wherein said flow component of said second molding material in said second die in a direction generally parallel to said joining surface flows across said joining surface.

7. The method according to claim 6 further comprising forming a narrow portion in a flow path of said second molding material adjacent said joining surface.

8. The method according to claim 1 further comprising:

forming said first die by mating a reference die with a first replacement die to form said first cavity;

leaving said first compact within said reference die; and forming said second die by mating said reference die with a second replacement die to form said second cavity.

9. The method according to claim 8 further comprising:

sliding said first replacement die to mate with said reference die; and sliding said second replacement die to mate with said reference die.

10. The method according to claim 8 further comprising:

rotating said first replacement die to mate with said reference die; and rotating said second replacement die to mate with said reference die.

11. The method according to claim 8 further comprising integrating said first and second replacement dies into a single component.

12. The method according to claim 1 further comprising maintaining a temperature of said first compact between 70° C. and an injection temperature of said second molding material after said molding of said first compact.

13. The method according to claim 1 further comprising maintaining an injection temperature between 95° C. and 230° C. for said second molding material during said molding of said second compact.

14. The method according to claim 1 further comprising:

forming said first molding material from a mixture of a first metal powder and a first binder, said first binder having a softening temperature and a decomposition temperature; and maintaining a temperature of said first compact between said softening temperature and said decomposition temperature.

15. The method according to claim 1 further comprising:

forming said first molding material from a mixture of a first metal powder and a first binder, said first binder having a softening temperature; and maintaining a temperature of said first compact higher than said softening temperature.

* * * * *